US005135409A

United States Patent [19]

Thompson

[11] Patent Number: 5,135,409

[45] Date of Patent: Aug. 4, 1992

[54] DEVICE FOR SECURING ELECTRICAL CORDS

[76] Inventor: Paul Thompson, P. O. Box 1414, Cardston, Alberta, Canada, T0K 0K0

[21] Appl. No.: 591,278

[22] Filed: Oct. 1, 1990

[30] Foreign Application Priority Data

Sep. 29, 1989 [CA] Canada ..... 615032

[51] Int. Cl.[5] ..... H01R 13/62

[52] U.S. Cl. ..... 439/367; 439/369

[58] Field of Search ..... 439/367, 368, 369, 371, 439/465, 466, 467, 459

[56] References Cited

U.S. PATENT DOCUMENTS 3,344,393 9/1967 Hendee ..... 439/369
4,420,204 12/1983 Leong ..... 439/465 X
4,449,015 5/1984 Hotchkiss et al. ..... 439/367 X
4,643,505 2/1987 House et al. .

FOREIGN PATENT DOCUMENTS 1166736 5/1984 Canada .
0257896 3/1988 European Pat. Off. ..... 439/367

*Primary Examiner*—Larry I. Schwartz
*Assistant Examiner*—Khiem Nguyen
*Attorney, Agent, or Firm*—Dressler, Goldsmith, Shore, Sutker & Milnamow, Ltd.

[57] ABSTRACT

A device for maintaining cooperating plugs on a pair of electrical cords connected comprising a generally elongate body adapted to enclose the plugs of a pair of electrical cords; said body comprising at least two cooperating members which, when engaged, form an enclosure for the plugs; at least two pairs of appendages affixed to the inside of the cooperating members; said appendages adapted to grip both electical cords so as to maintain the plugs in a connected relationship; and means to selectively engage and disengage the members comprising the body.

7 Claims, 1 Drawing Sheet

DEVICE FOR SECURING ELECTRICAL CORDS

FIELD OF INVENTION

This invention relates a device for securing the connection of electrical cords.

BACKGROUND OF INVENTION

Typically, electrical cord ends comprise male or female plugs which are adapted to cooperate in an interconnected fashion. Typically, the cords comprise a bundle of wires and insulating material (which is often covered by a sheath) with wires being attached to the plug. Tensile forces placed on the electrical cords during their use tend to cause the interconnected plugs to separate. Various methods are often used to prevent this separation which are unsatisfactory. For example, workmen often knot the connected ends of electrical cords together causing fatigue in the cords and also creating a undesirable protruberance on the cords which may bind on other objects.

The connected plugs of the electrical cords are particularly susceptible to the deleterious effects of water, dirt, and other foreign elements. It is desirable to protect the plugs from such elements and one method that workmen have used is to wrap the connected plugs of with electrical tape. Such wrapping does not provide a permanent solution and it takes a considerable amount of time to put the tape on and to take the tape off.

Canadian Patent No. 1,166,736 discloses a extension cord connector housing intended to be used to contain the interconnected plugs of a pair of extension cords. The device is intended to provide a streamline housing for plugs which maintain the plugs in a interconnected relationship. However, this device suffers from the disadvantage of consisting of a number of essential separate parts which may be lost on a work site. Furthermore, in order to use the device, time must be taken to carefully place the slotted washers described therein within appropriate slots in the housing so that the washers abut the plugs. Finally, the device is not adapted to remain fixed on a single cord for ready availability when it is desired to attach a second cord to the first.

OBJECTS OF THE INVENTION

It is an object of this invention to overcome the aforementioned disadvantages by providing a device for maintaining the connection of electrical cord plugs which does not comprise loose parts and which does not have to be adjusted before use. Furthermore, the aforementioned disadvantages are overcome by adapting the device to remain attached to the end of a first cord in such a matter as to permit the ready attachment of a second cord to the first.

SUMMARY OF THE INVENTION

This invention provides a device for maintaining cooperating plugs on a pair of electrical cords connected comprising a generally elongate body adapted to enclose the plugs of a pair of electrical cords; said body comprising at least two cooperating members which, when engaged, form an enclosure for the plugs; at least two pairs of of appendages affixed to the inside of the cooperating members; said appendages adapted to to grip both electrical cords so as to maintain the plugs in a connected relationship; and means to selectively engage and disengage the members comprising the body.

A device of this invention maintains plugs in a interconnected relationship by gripping the extension cords on both sides of the connected plugs as a result of the cooperation of pairs of members attached to the inside of the body of the device. Preferably, the gripping members comprises opposing, generally elongate posts with concave terminal or distal edges. While in cooperating relationship, the edges of the posts compress the electrical cord so as to grip it.

Preferably, the device consists of a body which comprises cooperating members which bear the gripping appendages. While engaged, the body members form a container which encloses the extension cord plugs. It is preferable that the body members be attached by means of the hinge. It is most preferable that the body comprise at least three members, two of which are connected by a hinge with the first and second members adapted to be disposed in a linear relationship and cooperate with the third member.

The aforementioned first member may be adapted to be fixed to one end of the third member by means of fasteners such as screw members. The cooperating appendages are attached to the inside of the first and third members so as to be in opposition to each other and grip one extension cord while the body members are engaged. This feature permits the device to be attached to a single electrical cord so that a second cord may be later, and readily, attached to the first cord.

It is preferable that at least the aforementioned second and third members be interconnected by a hinge and that both members bear similar opposing appendages for gripping a second extension cord. It is preferable to provide means for selectively engaging and disengaging the second and third members. Such means may comprise tongue and buckle or tooth and hook forms of fasteners.

DETAILED DESCRIPTION OF THE INVENTION

Figure 1:
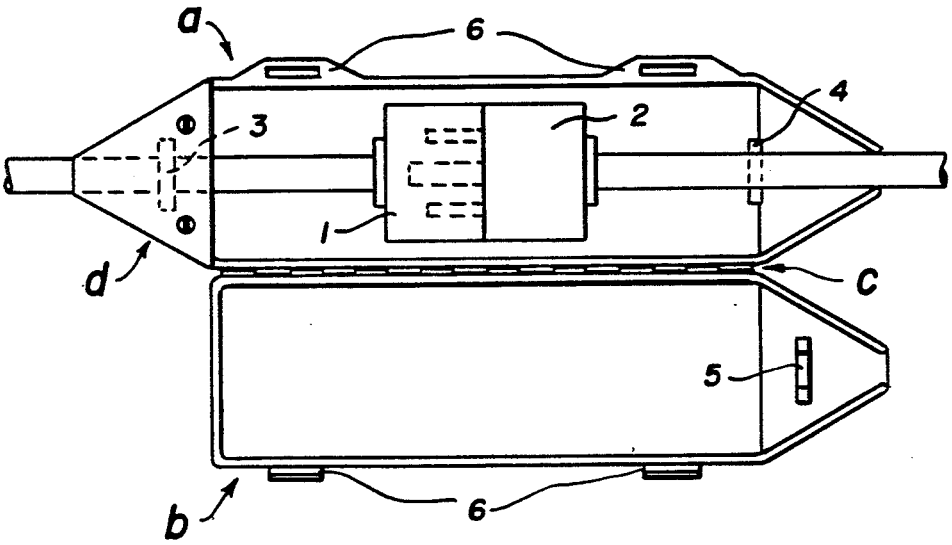
FIG. 1 is a top view, partially in section, of a connection device of this invention in a "open" position.
Figure 2:
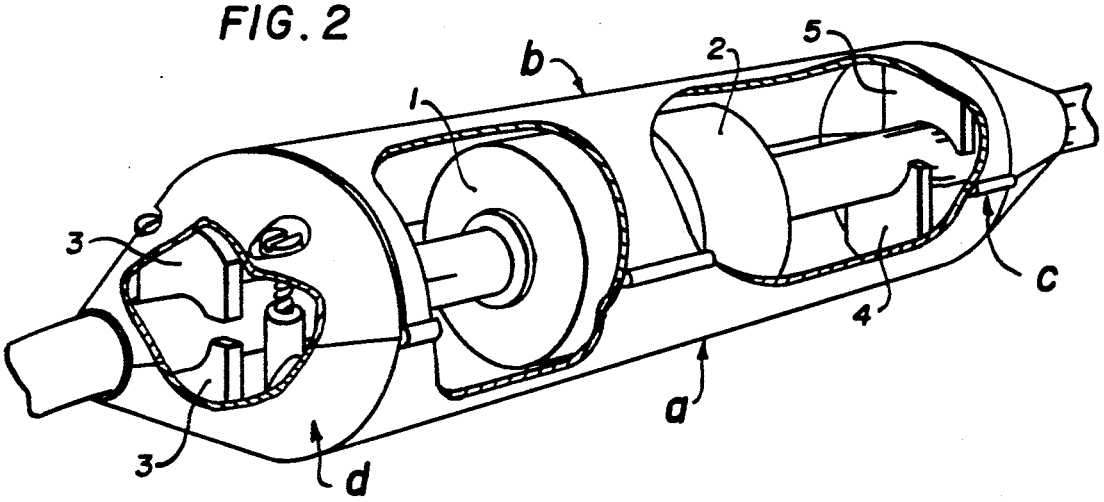
FIG. 2 is a perspective view, partially in section of the device shown in FIG. 1 in a "closed" position.

The device comprises a generally cylindrical body with tapered ends terminating in ports for the passage of extension cords. The body comprises members (a), (b) and (d). When disposed in a linear relationship, members (b) and (d) cooperate with member (a) which is substantially of the same length and shape to the combination of members (b) and (d). Member (b) is connected to member (a) by hinge (c).

Members (a), (b), and (d) are suitably dimensioned so that a pair of connected electrical cord plugs will be enclosed within the portion of the body formed by the cooperation of members (a) and (b).

Attached to the inside of one end of member (a) and the inside of member (d) are generally elongate posts (3) with concave distal edges. Posts (3) are attached to positions inside members (d) and (a) so that the posts ends directly oppose each other and cooperate to grip an extension cord when member (d) is engaged member (a). In this embodiment member (a) is attached to member (d) by means of screw fasteners.

The entire device may be permanently attached to one end of a single electrical cord. Most preferably, the device should be permanently attached to the end of an electrical cord that bears a female plug (1). This method is preferred because, most often, an electrical appliance will have only a male plug on its electrical cord. If it is intended to use this device to couple an electrical cord of an appliance with an electrical extension cord, it will be desirable that the device be permanently attached to the extension cord leaving the appliance cord free to be plugged into a wall outlet, etc. for other purposes.

Similar elongate posts (4) and (5) are attached to the inside of member (a) and to the inside of the opposing end of member (b) so as to similarly grip a second extension cord when members (a) and (b) are engaged in a closed "position". While in the closed position, member (b) is maintained in cooperation with member (a) by the provision of tongue and buckle fasteners (6).

While member (d) is fastened to member (a), there are no loose parts associated with the device. A second extension cord may be conveniently attached to the first extension cord by disengaging fasteners (6) and opening the body members (a) and (b). The second extension cord may then be attached (or removed) from the first extension cord. The device may then closed and the fasteners (6) engaged. When closed, the cooperating posts (4) and (5) of members (a) and (b) grip the second extension cord to prevent disengagement of plugs (1) and (2) when tensile forces are applied to the extension cord.

It is preferable that the body of this device be adapted to enclose electrical cord plugs of various sizes and be long enough in order that the cooperating posts will grip electrical cords with a variety of plug lengths. When fasteners such as screw fasteners are used, it is permissible for the posts (3) to be directly opposing. By varying the tension on the screw members, it is possible to grip extension cords of a variety diameters. Gripping of a second electrical cords of a variety of diameters may be most easily effected by positioning posts (4) and (5) to oppose each other in a offset fashion. The device will grip second cords of diameters greater than the "line of sight" diameter of the passage created between posts (4) and (5) in the closed position.

In this embodiment, the posts are adapted to grip the portion of the electrical cord comprising the wire bundle. This is advantageous because tensile forces will be transmitted directly from the wire bundle to the device and not through the inherently weak connection between the wire bundle and the plug.

It is preferable that this device be constructed of materials which will resist elements such as water, dirt, etc. Preferably, the device will be constructed of molded plastic which is not electrically conductive and is resistant to environmental elements. When constructed of plastic, posts (3), (4) and (5) may have resilience which will facilitate gripping extension cords of various diameters.

Preferably, hinge (c) is continuous to minimize the passage of water, dirt, etc. Appropriate sealing means such as compressible rubber strips may be provided between the body members and at the extension cord ports in the ends of the body to further prevent contamination by water, etc.

It is preferable that the exterior of the body be smooth or substantially free of protruberances so as to provide a streamlined profile in order to minimize binding of the device on other objects while the extension cords are moved.

While the invention has been described in detail and with reference to specific embodiments thereof, it will be apparent to one skilled in the art that various changes and modifications can be made therein without departing from the spirit and scope thereof.

What I claim as my invention is:

1. A device for maintaining the interconnection of cooperating plugs of a pair of electrical cords comprising a generally elongate body adapted to enclose said plugs when interconnected and a portion of each of the electrical cords, said body having two opposing sides and two ends, each end having an opening therethrough for the passage of an electrical cord, wherein the body comprises: three relatively moveable members, the first and second of said members being adapted to be disposed in linear relationship to form one of said sides of the body and to independently engage with the third of said members which forms the other of said sides; a first pair of generally elongate posts with concave distal edges attached to the first and third members adjacent one end of the body and adapted to be in opposing relationship and to grip an electrical cord therebetween when the first member is engaged with the third member; and, a second pair of generally elongate posts with concave distal edges attached to the second and third members adjacent the other end of the body and adapted to be in opposing relationship and to grip an electrical cord therebetween when the second member is engaged with the third member.

2. The device of claim 1 having fastening means to fix the engagement of the first and third members; a hinge means connecting the second and third members; and, means to selectively engage and disengage the second and third members.

3. A device for maintaining the interconnection of cooperating plugs of a pair of electrical cords comprising a generally elongate body adapted to enclose said plugs when interconnected and a portion of each of the electrical cords, said body having two opposing sides and two ends, each end having an opening therethrough for passage for an electrical cord; wherein the body comprises: three relatively moveable members, the first and second of said members being adapted to be disposed in linear relationship to form one of the sides of the body and to independently engage with the third of said members which form another of the sides of the body; at least one pair of appendages attached to the second and third members adjacent one end of the body, said appendage being adapted to be in opposing relationship and to grip a first electrical cord therebetween when the members are engaged; and, means to fix a second electrical cord to one of the members adjacent the other end of the body.

4. The device of claim 3 wherein the means to fix the second electrical cord is a pair of appendages attached to the first and third members, said appendages being adapted to be in opposing relationship and to grip the second electrical cord therebetween when the first and third members are engaged.

5. The device of claim 3 wherein the appendages are elongated posts with concave distal edges.

6. The device of claim 3 having fastening means to fix the engagement of the first and third members; a hinge means connecting the second and third members; and, means to selectively engage and disengage the second and third members.

7. The device of claim 6 wherein the means for selectively engaging and disengaging the second and third members is one or more tongue and buckle fasteners.

* * * * *